United States Patent [19]

Brada et al.

[11] 4,041,733

[45] Aug. 16, 1977

[54] YARN GUIDE CONTROL

[75] Inventors: Pavel Brada; Jaromír Kučera; Otokar Chládek; Gustav Voda; Jindrich Nováček; Jan Kollmann, all of Trebic, Czechoslovakia

[73] Assignee: Elitex, Liberec, Czechoslovakia

[21] Appl. No.: 672,844

[22] Filed: Apr. 2, 1976

[30] Foreign Application Priority Data

Apr. 3, 1975 Czechoslovakia ..... 2270/75

[51] Int. Cl.[2] ..... D04B 15/58

[52] U.S. Cl. ..... 66/138

[58] Field of Search ..... 66/125 R, 138

[56] References Cited

U.S. PATENT DOCUMENTS

| | | | |
|---|---|---|---|
| 3,101,601 | 8/1963 | Tenconi | 66/138 |
| 3,587,251 | 6/1971 | Vincoli | 66/125 R |
| 3,928,988 | 12/1975 | Luth | 66/138 |

FOREIGN PATENT DOCUMENTS

| | | | |
|---|---|---|---|
| 1,069,813 | 11/1959 | Germany | 66/125 |
| 1,361,621 | 7/1974 | United Kingdom | 66/138 |

*Primary Examiner*—Mervin Stein
*Assistant Examiner*—A. M. Falik

[57] ABSTRACT

A yarn guide is controlled by a pair of resiliently biased pneumatically operated pistons arranged cooperatively to alternately exert a directional movement on said yarn guide in opposite directions. One of the pistons engaging with the yarn guide to arrest its movement, in the absence of a pneumatic impulse to either piston.

5 Claims, 7 Drawing Figures

YARN GUIDE CONTROL

BACKGROUND OF THE INVENTION

The present invention relates to apparatus for controlling the yarn guides of multifeed circular knitting machines by means of pneumatical and mechanical means.

Circular knitting machines are known, in which yarn is fed to the needles through yarn guides and cams which are movable between operative and inoperative positions by pneumatic means. In general, the yarn guides are controlled by a piston mounted in a pneumatic cylinder which acts against a spring. Thus, the yarn guide is controlled into its operative, or inoperative position, respectively by either introducing or not introducing a pneumatic signal first into the cylinder. During its stay in operative position the yarn guide held there by the piston under a continuous injection of pressurised air to the cylinder. The pressurized air is fed to the guide from a source via a central distribution valve controlled from a control drum of the machine.

The known pneumatic devices operate as a whole reliably. However, they do have a disadvantage consisting in that it is necessary, in order to maintain the yarn guide in operative position, to maintain constant pressure in the pressurized air feeding duct. Thus, it is necessary to manufacture the pneumatic cylinder, in which the piston is mounted with a high degree of precision, and to seal the piston very accurately so as to avoid air losses and pressure drop, which if allowed to accrue would cause the guide to move from its correct operative position. Laying of yarn would be performed at an incorrect angle and the knitwork structure could become faulty.

It is an object of the present invention to provide apparatus for controlling the movement of yarn guides which overcomes the above mentioned disadvantages.

It is another object of the present invention to form a pneumatic device operating in response to a short duration pressure impulse without any pressure drop.

It is a further object of the present to provide a device consisting of two alternately controlled resilient pistons arranged for controlling at least one guide into both its operative and inoperative position.

The foregoing objects, other objects and advantages will be obvious from the following disclosure.

SUMMARY OF THE INVENTION

According to the present invention, a multifeed circular knitting machine is provided with apparatus for controlling the movement of any of its yarn guides, which is pivotally mounted for movement into and out of operative and inoperative positions. The apparatus includes a pair of resiliently biased pneumatically operable pistons cooperatively arranged to alternatively exert a directional movement on said yarn guides in opposite directions. One of the pistons is provided with pawl means which engages within a slot on the guide, cooperating therewith to secure the lever against movement in the absence of a pneumatic impulse to either piston.

Preferably, the pneumatic impulse is derived from a source of pressurized air via a valve system comprises at least one serially associated check valve and a servo-air-valve, the servo-valve being responsive to the operation of one of a selected number of control elements of the knitting machine. Preferably, a plurality of associated check valves and servo-valves are employed, each responsive to a different control element.

Full details of the present invention are set forth in the following description and are shown in the accompanying drawings.

DESCRIPTION OF THE INVENTION

Figure 7:
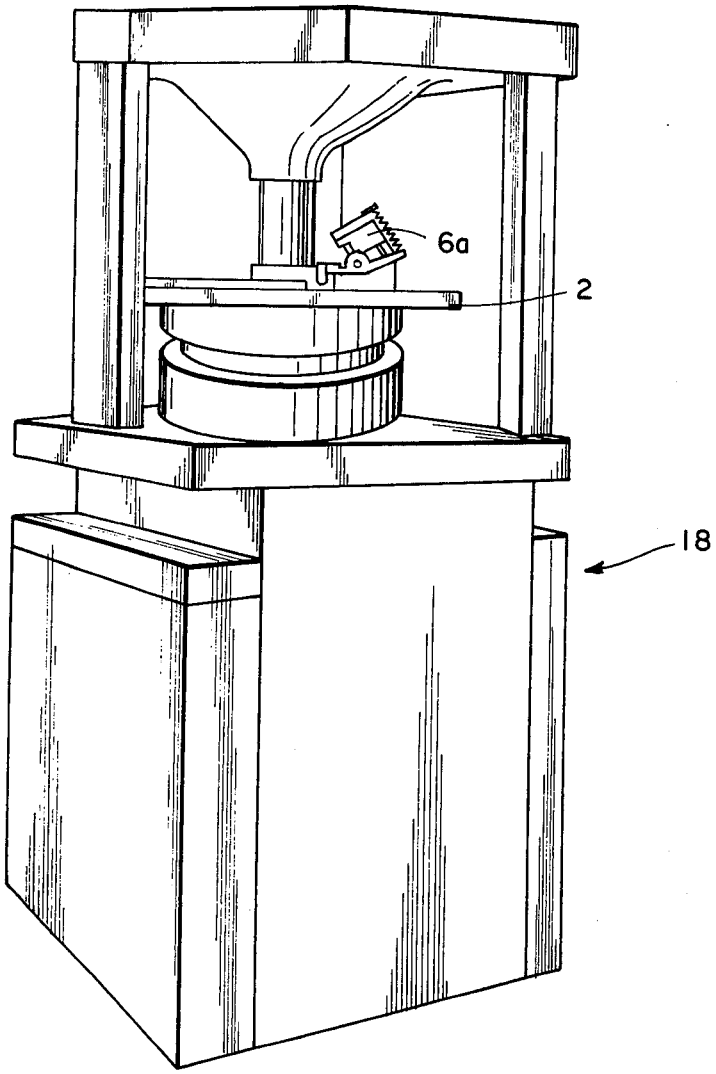
FIG. 7 is a diagrammatic representation of a multifeed circular knitting machine incorporating the yarn guide of the present invention.

The drawings depict a single yarn guide and pneumatic control system adaptable to any of the known and conventional circular knitting machines such as 18 in FIG. 7. The structure of the knitting machine per se follows the known form and is therefore not depicted here. Each machine includes a needle cylinder in which a plurality of needles are displaceably mounted and controlled by independent selector and cam system located about the cylinder in association with separate feed systems. Yarn is fed to the needles in each of a plurality of sections or feeds through an associated guide arranged therein.

The yarn guide apparatus **6*a* according to the present invention adapted for the foregoing purpose, comprises a tubular guide 1 through which the yarn is adapted to pass. The guide is mounted at one end of a lever 1*a* which is pivoted about a central fulcrum axle 1*b* borne on the machine frame 2 by a housing 3, provided with a pair of spaced depending legs through which the lever 1*a* freely passes. The housing 3 contains the pneumatic control mechanism consisting of a pair of spaced pistons movable within corresponding cylinders formed in an otherwise solid block 6 forming the remainder of the housing 3. The pistons 4 and 5 pivot the fulcrum 1*b*as indicated by the arrows A and B to move the yarn guide 1 between an operative position shown in FIG. 2 and an inoperative position shown in FIG. 3**. In the operative position the yarn is brought into proximity with the operatively position needles of the needle cylinder to effect the formation of loops, as is known.

Figure 1:
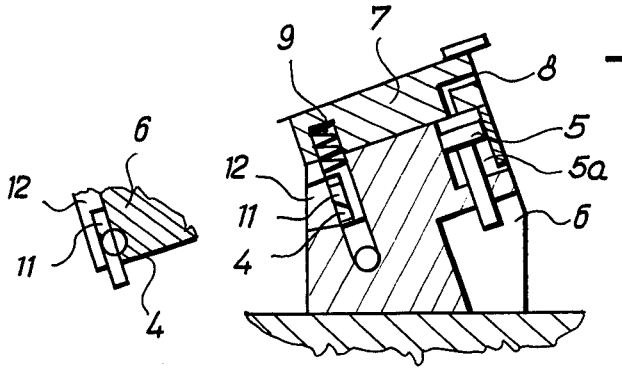
FIG. 1 is a sectional view through the pneumatic control apparatus of the present invention, showing each of the pistons.

As seen in FIG. 1, the pneumatic control mechanism contained in the housing block 6 comprises a first piston 4 movable in a line perpendicular to the arm of the lever **1*a* between the yarn guide 1 and the fulcrum axle 1*b* and a piston 5 having an extending arm adapted to engage the opposite arm of the lever 1*a*. Neither piston 4 or 5 is provided with seal rings or other means for sealing or tightening the piston with respect to their cylinders. The top of the body 6 is capped with a cover 7 which closes the respective cylinders for the pistons 4 and 5**.

The cap may be screwed or otherwise fastened to the body.

Figure 4:
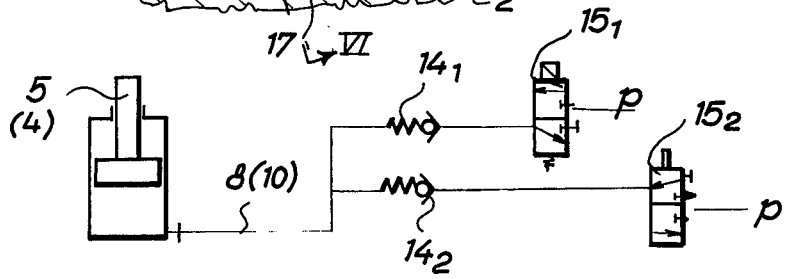
FIG. 4, is a schematic diagram of the pneumatic valve system.

The lid 7 is provided with a duct 8 leading to the cylinder 5*a* in which the piston 5 is housed. The duct 8 is provided with suitable fittings and a conduit leading to a source of pressurized air via a valve control system, as depicted in FIG. 4. The lid 7 is also provided with a recess aligned with the cylinder in which is housed the piston 4. A compression spring 9 is lodged in the recess so as to continuously be urged against the piston 4. Thus, piston 4 is normally based by mechanical means so that it extends outwardly in the direction of the lever 1*a* while piston 5 is freely movable in its cylinder and is responsive to the application of air pressure to it.

Figure 5:
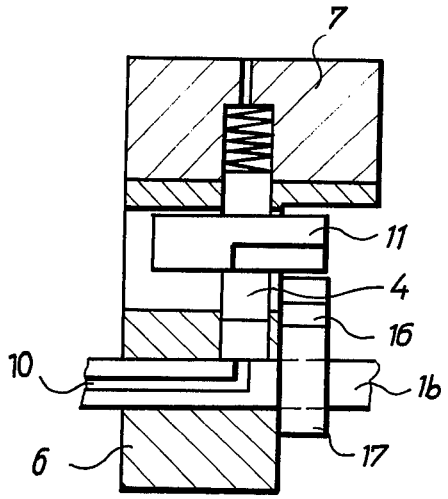
FIG. 5, is a sectional view taken along line V—V of FIG. 2.

A duct 10 connected to a source of pressurized air and a valve system such as shown in FIG. 5, passes through the body 6 opening beneath the piston 4, so as to present pressurized air beneath the piston in a direction opposite to the bias of spring 9. The piston 4 is provided on its outer side with a pawl 11 which extends below the end of the piston 4 directly in line with the lever 1*a.* The opposite end of the lever 1*a* is biased by a tension spring 13 connected at its end to the cap 7. The tension spring 13 exerts a normal bias on the lever 1*a* which is counterclockwise as viewed in the drawing. The body 6 is also provided with an opening 12 extending laterally from the piston 4 to the side of the body.

Figure 6:
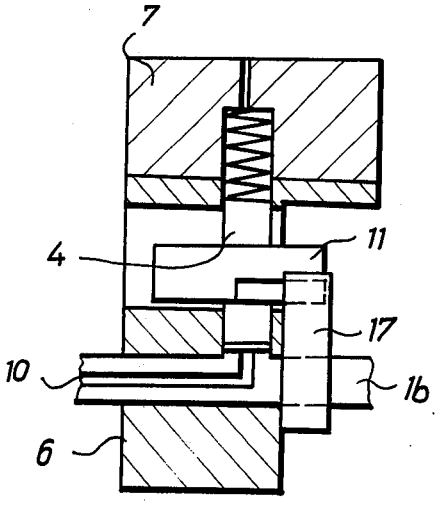
FIG. 6 is a sectional view taken along line VI—VI of FIG. 3.

The lever 1*a* is provided with a central circular hub 17 which is formed with a slot 16 which runs approximately tangential to the fulcrum axle 1*b* of the yarn guide arm and which is adapted to receive the pawl 11 under normal bias of the piston 4 by the spring 9. As seen in FIGS. 5 and 6, the piston 4, pawl 11 and hub 17 define with the body 6 a chamber 18 which is closed (i.e., sealed) when the piston is urged downwardly by spring 9, (e.g.: when the pawl engages in the slot 16) and open (i.e., unsealed) when the piston is forced upwardly by pressurized air so that the pawl is raised into sliding engagement with the surface edge of the hub 17.

Both the duct 8 leading to piston 5 and the duct 10 leading to the piston 4 are connected to a source of pressurized air P, such as a compressor, tank or the like via the system illustrated in FIG. 4. The system comprises two or more unidirectional check valves $\mathbf{14}_1$ and $\mathbf{14}_2$ (such as ball valves) connected in parallel with the duct line 8 or 10 and in series respectively to a solenoid or mechanically operated 3/2 servo-air valve $\mathbf{15}_1$ and $\mathbf{15}_2$. For the control of the piston 5 one of the valves 15 is preferably responsive to the patterning or control drum of the knitting machine, while the other valve 15 is responsive to the patterning or calculating control chain, conventionally used in such machine. Similarly, the flow of pressurized air in duct 10 controlling piston 4 is regulated via the control drum, the calculating chain and in addition by the needle cylinder, via a cam mounted thereon. For start up of knitting it is preferred that the cam be mounted with respect to the needle cylinder so that it rotates synchronously therewith and actuates the air valve at a point which corresponds to the location of the knitting or yarn feed. The 3/2 valves are preferably located, if mechanically controlled, as close to the drum, control chain or needle cylinder as is possible to avoid the need for any extending linkages. The servo-air valves are conventional valves adapted to provide a short burst or impulse of air, in response to a given signal (electrical or mechanical). Such valves are commercially available.

Figure 3:
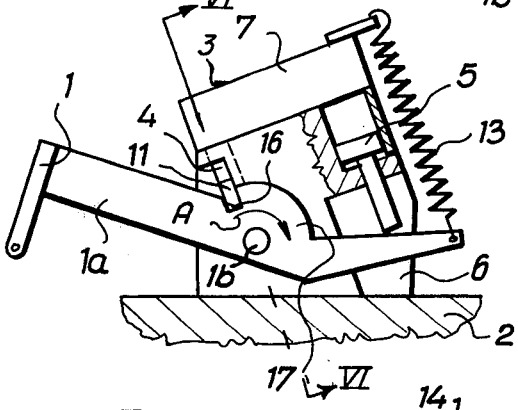
FIG. 3, is a view similar to FIG. 2 showing the yarn guide in inoperative position.

The operation for controlling the movement of the yarn guide is as follows:

In the inoperative position of the yarn guide 1, as seen in FIGS. 3 and 6, the lever 1*a* is held by the pawl 11 from moving counterclockwise, and maintains the tubular guide 1 in its lifted position away from the needle cylinder. Because of the tension on spring 13, which normally urges the lever in the counterclockwise direction, and the force of the compression spring 9, the pawl 11 is firmly seated by being pinched in the slot 16.

Figure 2:
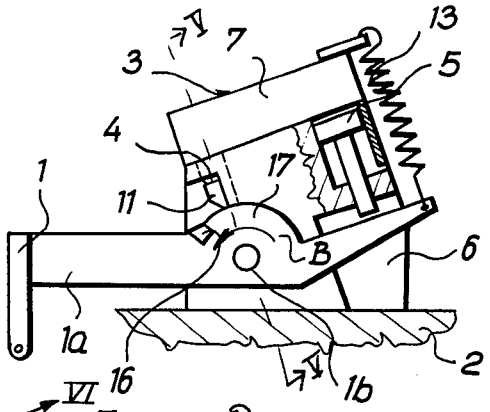
FIG. 2, is a side view of the apparatus shown in FIG. 1, partially sectioned and showing the yarn guide in operative position.

In order to initiate knitting, the guide 1 must be first moved into the operative position shown in FIG. 2. To effect this a cam is mounted on the needle cylinder preferably on the cylinder in the region of the appurtenant feed, which upon the first revolution of the needle cylinder displaces the connected 3/2 way pneumatic valve 15 into a position in which a pressurized air impulse of short duration is passed from the source through the corresponding check valve into duct 10. As a result, chamber 18 is pressurized, lifting the piston 4, whereupon pawl 11 is also lifted out of engagement with the slot 16. By this action, spring 13 causes the lever 1*a* to pivot counterclockwise in the direction of arror B swinging the guide 1 into operative position as shown in FIG. 2. As the pawl 11 is released from slot 16 it is caused to slide over the edge of the hub (FIG. 5) which because of its curvature acts to additionally force the piston 4 into its uppermost position. Simultaneously, the piston 5 which moves freely in its cylinder 5*a* moved by the rear arm of the lever 1*a* into its upper position. The check valve 14 does not permit any pressure drop in line 10 due to feed back and thus the correct operation is assured even with short duration air impulse. When guide 1 has, however, reached its operative position secured by spring 13, then air slowly escapes from below piston 4 and the pawl 11 due to the lack of sealing in its mounting in the body 6. The guide is held in the operative position throughout knitting by the bias of spring 13.

In order to disengage the yarn guide 1 from its operative position, the switching of one of the 3/2 valves 15 leading to duct 8 is effected, from machine control drum or the control chain. This valve 15 is brought into a position in which another signal of short duration is created sending a burst of pressurized air through the associated valve 14 into duct 8. This air causes an outward displacement of piston 5 into the position as shown in FIG. 3 wherein it causes the lever 1*a* to move clockwise (arrow A) against action of spring 13. Upon full movement of the lever 1*a* the spring 9 pressing against piston 4 causes the pawl 11 to again engage into slot 16 securing the guide 1 in its inoperative position.

In the manner as given above, the yarn guide 1 may be controlled in its movement into either one of the two positions not only from the control drum, or from the needle cylinder, but also from the calculating chain, depending from the necessity of maintaining the time interval of this position in view of knitting certain knitwork parts, more or less precisely. The guide 1 may be controlled from needle cylinder at the start of the knitting operation, at any stage and in each of the feed systems.

The advantage of the device according to the present invention consists in that the yarn guides are controlled by short duration pneumatic impulses and that the control pistons need not be sealed, as the system operates substantially as a flip-flop circuit. A further advantage consists in that, via the parallel check valve system, it is possible to control the yarn guide from various control elements, thus achieving the required degree of accuracy in controlling the operation of the yarn guides.

It will be observed that the system comprises basically a pair of pneumatically operable pistons, which are arranged to operate in alternate directions by combination with spring biasing means. That is when the piston 4 and spring 9 work oppositely to the piston 5 and spring 13, on receipt or absence of a pneumatic impulse.

Various changes, modifications and embodiments have been suggested in the foregoing description, others will be obvious to those skilled in the art. It is intended therefore that the present disclosure be taken as illustrative only and not as limiting of the present invention.

What is claimed is:

1. In a multifeed circular knitting machine apparatus for controlling the movement of a yarn guide secured at the end of a lever for pivotal movement between an inoperative and operative position comprising spring means for normal biasing said lever in the operative position, a first pneumatical piston actuable on said lever to selectively move said lever against said bias in response to a pneumatic impulse, a second pneumatic piston having a pawl, a recess formed in the lever at a position corresponding to said pawl when said lever is moved into the inoperative position, and spring means biasing said second piston to cause said pawl to normally engage said lever, said second piston being operable on receipt of a pneumatic impulse to release said pawl and permit said lever to move into the inoperative position.

2. The apparatus according to claim 1 including a source of pressurized air, and means for supplying a pneumatic impulse from said source to a selected one of said pistons.

3. The apparatus according to claim 2, wherein said means for supplying said pneumatic impulse comprises at least one check valve and an air valve arranged in series therewith, said air valve being operable to permit the passage of a pneumatic impulse in response to a signal obtained from one of a selected number of knitting machine control elements.

4. The apparatus according to claim 3 including a plurality of check valves and associated serially connected air valves, each check valve and associated air valve being arranged in parallel with respect to each other, and being connected in response to the operation of a different control element of said knitting machine.

5. The apparatus according to claim 3 wherein said air valve arranged in series with said piston which is provided with said pawl is responsive to the movement of a cam mounted to rotate sychronously with the needle cylinder at a point which corresponds to the location of the knitting feed with respect to the needle cylinder.

* * * * *